United States Patent [19]

Hoffmann

[11] Patent Number: 4,835,363

[45] Date of Patent: May 30, 1989

[54] ELECTRIC STEAM IRON HEATED BY HALOGEN LAMP AND HAVING A CERAMIC SOLE PLATE

[75] Inventor: Erich Hoffmann, Bergisch Gladbach, Fed. Rep. of Germany

[73] Assignee: Robert Krups Stiftung & Co. KG., Solingen, Fed. Rep. of Germany

[21] Appl. No.: 50,611

[22] Filed: May 15, 1987

[51] Int. Cl.[4] ..... H05B 3/00; D06F 75/00

[52] U.S. Cl. ..... 219/258; 38/77.8; 38/82; 38/88; 219/228; 219/243; 219/254; 219/346; 219/354

[58] Field of Search ..... 219/243, 245–259, 219/230, 222–226, 227, 228, 464, 346, 349, 347, 354; 38/77.1–77.83, 82, 88, 81

[56] References Cited

U.S. PATENT DOCUMENTS

| | | | |
|---|---|---|---|
| 1,010,092 | 11/1911 | Thomas | 38/88 X |
| 1,373,879 | 7/1921 | Franks et al. | 38/77.6 |
| 1,431,419 | 10/1922 | Pollard | 38/77.6 |
| 1,708,079 | 4/1929 | Brewer | 219/258 X |
| 2,179,890 | 11/1939 | Kaplan | 219/258 |
| 2,222,327 | 11/1940 | Walkup | 219/245 |
| 2,241,067 | 5/1941 | Holm-Hansen | 38/81 |
| 2,357,905 | 9/1944 | Olving | 38/88 X |
| 2,397,236 | 3/1946 | Boyd | 219/245 X |
| 2,403,115 | 7/1946 | Olving | 219/258 X |
| 3,098,922 | 7/1963 | Paxton | 219/254 |
| 3,384,526 | 5/1968 | Abramson et al. | 219/349 |
| 3,723,697 | 3/1973 | King | 219/347 X |
| 3,906,187 | 9/1975 | Turoczi | 219/245 X |
| 4,178,500 | 12/1979 | Brindopke | 219/351 X |
| 4,296,311 | 10/1981 | Hagglund et al. | 219/464 |

FOREIGN PATENT DOCUMENTS

| | | | |
|---|---|---|---|
| 134090 | 3/1985 | European Pat. Off. | 219/346 |
| 947242 | 7/1982 | U.S.S.R. | 38/77.83 |
| 1155641 | 5/1985 | U.S.S.R. | 38/77.1 |

*Primary Examiner*—Anthony Bartis
*Attorney, Agent, or Firm*—Peter K. Kontler

[57] ABSTRACT

An electric iron wherein a cermic sole plate transmits infrared light and is heated by one or more halogen lamps within a reflector in the housing of the iron whose concave surface faces the lamp or lamps and reflects heat upon the sole plate. The reflector further effects the heating of water which is admitted into a steam chamber in the housing of the iron between the reflector and the ceramic sole plate, and the resulting steam is conveyed to nozzles extending into openings in the sole plate.

8 Claims, 1 Drawing Sheet

ELECTRIC STEAM IRON HEATED BY HALOGEN LAMP AND HAVING A CERAMIC SOLE PLATE

BACKGROUND OF THE INVENTION

The invention relates to electric household appliances in general, and more particularly to improvements in electric irons, especially steam irons.

The sole plate of a portable electric iron is normally heated by one or more electric resistance heaters which are installed in the interior of the housing. Each resistance heater includes one or more wire-like resistors which can be connected in circuit with a source of electrical energy whereby the resistors emit heat which is directed into the sole plate. The resistance heater or heaters can be installed in the sole plate. Such heating systems exhibit a number of serious drawbacks. Thus, the initial and assembly cost of electric resistance heaters is rather high, especially since they must be mounted on carriers of electrically insulating material. Moreover, it takes a relatively long interval of time to heat an electric resistance heater until it begins to emit heat at the desired rate, and it takes a relatively long interval of time to ensure that an electric resistance heater is adequately cooled upon completion of an ironing operation. Thus, large quantities of heat energy are lost during heating and cooling of the sole plate; this evidently entails huge losses in electrical energy.

It is further known to equip portable electric irons with any one of a wide variety of sole plates. For example, a conventional sole plate can be made of a single piece of metallic material, especially aluminum or steel. An advantage of aluminum is that its heat conductivity is quite satisfactory and that its specific weight is relatively low; however, the ability of an aluminum sole plate to resist scratching, scoring and similar damage is unsatisfactory. A sole plate which is made of steel is more resistant to wear; however, its weight is rather high and its thermal conductivity is not satisfactory.

It was already proposed to make a sole plate of two pieces consisting of different materials. For example, a main body portion or core which is electrically heatable and is made of aluminum carries a thin-walled base plate of steel which comes in actual contact with the article to be ironed. This not only increases the cost of the sole plate and of the entire iron but also brings about other drawbacks. For example, if the iron is a steam iron so that the sole plate must have openings for discharge of steam, the relatively thin base plate tends to undergo permanent deformation in the region of such openings. This imparts to the article-contacting surface of the sole plate an undulate or other undesirable shape which affects the quality of the ironing operation.

OBJECTS AND SUMMARY OF THE INVENTION

An object of the invention is to provide an electric iron, especially a steam iron, which is constructed and assembled in such a way that the interval which is required to heat or cool the sole plate is a small fraction of the interval which is necessary to effect similar changes of temperature of the sole plate in a conventional iron.

Another object of the invention is to provide a novel and improved heating system and a novel and improved sole plate for use in an electric iron.

A further object of the invention is to provide a novel and improved method of heating the sole plate of an electric iron.

An additional object of the invention is to provide an electric iron wherein the ironing action of the sole plate is more satisfactory than that of sole plates in conventional irons.

Still another object of the invention is to provide a portable electrical appliance, especially an electric iron, which exhibits the above outlined features and advantages and can be operated by connecting it to available sources of electrical energy.

A further object of the invention is to provide a novel and improved electric iron which need not employ any electric resistance heaters.

Another object of the invention is to provide an electric iron with a sole plate which can be heated to required temperature practically instantaneously and which can be cooled just as rapidly to thus reduce the likelihood of injury to the operator and/or damage to ironed articles or to articles which are about to be ironed.

An additional object of the invention is to provide a relatively simple, compact and inexpensive electric iron whose energy requirements do not exceed and can be much lower than those of conventional electric irons which employ resistance heaters.

A further object of the invention is to provide an electric iron whose initial and assembly costs are less than those of heretofore known electric irons but which is superior to conventional electric irons in a number of important respects.

The invention resides in the provision of an electric iron, particularly a steam iron, which comprises a housing having a handle, a sole plate which is secured to the housing, and means for heating the sole plate. The heating means includes at least one halogen lamp in the housing.

The sole plate is preferably made of or contains a material which can store heat energy and transmits infrared light. A presently preferred material is a ceramic material, particularly a vitreous enamel such as Ceran (trademark).

The heating means further comprises reflector means which is provided in the housing to reflect upon the sole plate heat which is emitted by the lamp or lamps. The reflector means can include a portion having a concave surface which faces the lamp and the sole plate and has a center of curvature in or close to the plane of the sole plate.

The housing can define or contain a steam chamber whose contents are heated by heat which is emitted by the lamp or lamps and/or by heat which is reflected by the reflector means. Such iron further comprises means for admitting water into the steam chamber and means for conveying steam from the chamber. The reflector means can surround at least a portion of the steam chamber and the steam conveying means can include one or more steam discharging nozzles disposed in or adjacent to openings which are provided in the sole plate, and means for connecting each nozzle with the steam chamber. The sole plate can have a substantial number of openings in a predetermined distribution (e.g., at equal distances from each other), and each opening can confine or is adjacent a discrete steam discharging nozzle.

Each lamp of the heating means is mounted in one or more sockets which are installed in the housing, and at least one socket for each lamp is connectable with an outside source of electrical energy or with an energy source in the housing or its handle (e.g., with a rechargeable battery).

The novel features which are considered as characteristic of the invention are set forth in particular in the appended claims. The improved electric iron itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
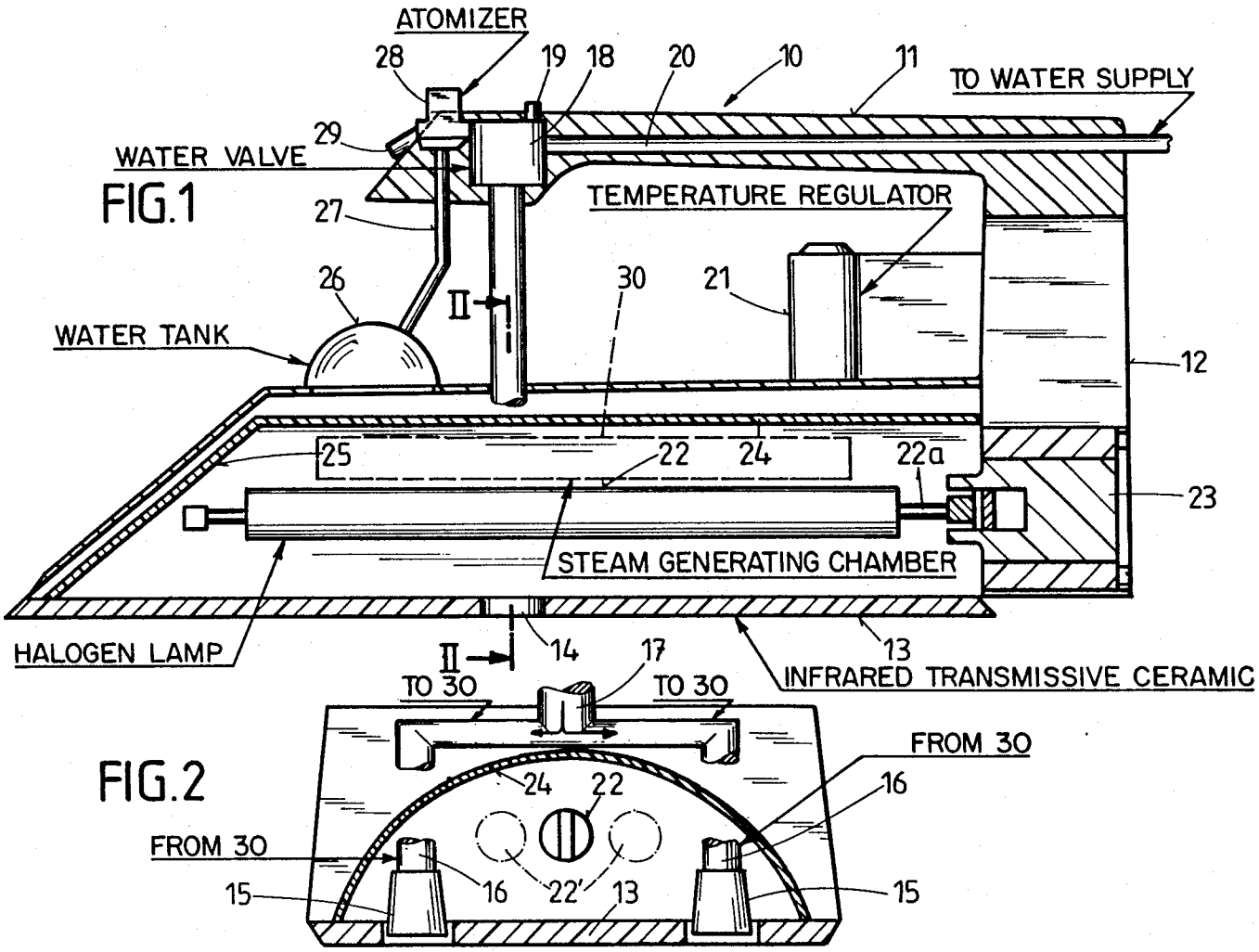
FIG. 1 is a diagrammatic longitudinal vertical sectional view of an electric iron which embodies one form of the invention.
FIG. 2 is a fragmentary transverse vertical sectional view as seen in the direction of arrows from the line II—II of FIG. 1.

The elcetric iron 10 which is shown in FIGS. 1 and 2 is a steam iron comprising a housing 12 with a handle 11, a novel and improved sole plate 13 which is affixed to the housing 12, and novel and improved means for heating the sole plate. The configuration and dimensions of the housing 12, its handle 11 and/or sole plate 13 can be conventional. Furthermore, the manner in which the electric heating element or elements of the means for heating the sole plate 13 can be connected to an outside source of electrical energy (e.g., a wall outlet) by means of an electric cable is or can be the same as in conventional irons and, therefore, the connection between a socket 23 in the rear portion of the housing 12 and the energy source is not shown in the drawing. The same applies for controls which are provided on the housing 12, preferably in the region of the handle 11, to turn the heating means on or off as well as to select the intensity of the heating action when the iron is in actual use. The drawing merely shows those parts of the improved iron 10 which are necessary for full understanding of the present invention.

The housing 12 and the handle 11 can be made of a plastic material, and the sole plate 13 can be attached to the underside of the housing 12 in the same way as known from conventional irons. The handle 11 is or can be integral with the housing 12 and, in accordance with a feature of the invention, the sole plate 13 is made of a ceramic material which transmits infrared radiation. Moreover, the material of the sole plate 13 is preferably such that it can accumulate and store heat which is transmitted thereto by one or more heating elements in the form of elongated rod-like halogen lamps. FIG. 2 shows a centrally located halogen lamp 22 by solid lines and two additional halogen lamps 22' by broken lines. The rear end portion **22*a* of the lamp 22 is separably connected to the socket 23 in the rear wall of the housing 12, and the front end portion of the lamp 22 is connected to a similar or analogous socket (not specifically shown) in the front portion of the housing 12**.

One of the presently preferred materials for the making of the sole plate 13 is Ceran (trademark) which readily transmits infrared light and can store large amounts of heat energy. Other ceramic materials or any other materials which exhibit the aforediscussed desirable properties of Ceran and are also suitable for the making of sole plates on additional grounds (such as stability, reasonable cost, resistance to scoring and ability to stand the temperatures which develop in the course of an ironing operation) can be used with equal or similar advantage.

The halogen lamps 22, 22' can constitute commercially available articles each of which has an elongated hollow tubular envelope with the aforementioned end portions insertable into the respective sockets including the socket 23 at the rear end of the housing 12. The front socket or sockets (which can be identical with the illustrated socket 23) can be omitted if the mounting of the lamp or lamps in a single socket is adequate for anticipated use of the electric iron. It is preferred to employ one or more halogen lamps which emit radiation containing a high or relatively high percentage of infrared light. The socket or sockets 23 are also conventional, the same as the terminals which are embedded therein for connection to the respective end of an electric cable, not shown.

The lamp 22 is partially or completely surrounded by a reflector 24 which includes a rear portion in the form of a concavo-convex shell of metallic or other material having a concave underside which faces the lamp or lamps and the upper side of the sole plate 13. The center of curvature of the concave side of the shell-like portion of the reflector 24 is located in or close to the plane of the sole plate 13. The lamp 22 is preferably located in the focus of the shell-like portion of the reflector 24. The front portion 25 of the reflector 24 resembles a hollow wedge whose configuration conforms, either substantially or exactly, to the configuration of the normally pointed and forwardly and downwardly tapering front portion of the housing 12. The reflector 24 not only directs reflected radiation against the sole plate 13 but also serves as a means for shielding the housing 12 from heat which is radiated by the lamp or lamps within the confines of the shell-like rear portion of the reflector.

The sole plate 13 is formed with a pattern of suitably distributed openings 14 (only two shown in FIG. 2) which receive portions of or are merely adjacent to discrete steam discharging nozzles 15. These nozzles are connected with a steam chamber 30 (shown schematically in FIG. 1) by discrete steam supplying conduits 16. The chamber 30 is or can be defined by the housing 12 and is surrounded, at least in part, by the reflector 24 so that the latter reflects heat energy which is necessary to heat water in the chamber 30 to its boiling point. Droplets or even larger quantities of water are admitted into the chamber 30 by way of a substantially vertically extending pipe 17 which is connected with the outlet port of a two-way valve 18 in the handle 11. The inlet port of the valve 18 is connected with a source (not shown) of water in the handle 11 or in or outside of the housing 12 by a channel 20 which is machined into or otherwise formed in the handle 11. An actuator 19 is provided on the handle 11 within reach of a finger of the hand grasping the handle to open the valve 18 when necessary and to admit water into the steam chamber 30. In accordance with one presently preferred embodiment, a relatively small water tank can be mounted at the rear side of the housing 12 so that it can supply water into the channel 20 and thence into the steam chamber 30 in response to opening of the valve 18 by way of the actuator 19 (e.g., a pushbutton or the like). The valve 18 is a commercially available product.

It is preferred to place the lowermost portions of the nozzles 15 at a level at least slightly above the underside of the sole plate 13 so as to ensure that the nozzles will not come in actual contact with a garment or with any other article which requires ironing. The number of openings 14 and nozzles 15 (and hence conduits 16) can greatly exceed two. The dimensions of the openings 14, nozzles 15 and conduits 16 are greatly exaggerated for the sake of clarity. A regular distribution of a large numer of relatively small identical openings 14 in the entire sole plate 13 is preferred in many instances.

The housing 12 supports a further water tank 26 (shown schematically in front of the pipe 17) whose outlet is connected to an atomizer 28 at the front end of the handle 11 adjacent the actuator 19 for the valve 18. The atomizer 28 can be actuated by one finger of the hand holding the handle 11 to direct a spray of atomized water through an outlet 29 and upon the article to be ironed so that the spray impinges upon the article in front of the pointed tip of the housing 12 and sole plate 13. The tank 26 is provided with a cap or the like (not shown) so as to permit for convenient refilling with a supply of liquid which is to be sprayed when the iron is in use. The arrangement is such that the user of the iron can actuate the valve 18 independently of the atomizer 28 or vice versa. If desired, the actuator of the atomizer 28 can be placed sufficiently close to the actuator 19 to ensure that these actuators can be reached (either jointly or individually) by one and the same finger.

The character 21 denotes in FIG. 1 a regulator which can be adjusted to conform the heating action to the nature of the material of the article or articles to be ironed. Such regulators are well known in the field of electric irons.

The improved iron is susceptible of many modifications without departing from the spirit of the invention. Thus, the housing 12 can contain only one of the three illustrated halogen lamps or two, four or more such lamps. Moreover, the distribution and orientation of halogen lamps in the interior of the housing can be altered in any desired and suitable way. Moreover, and if the means for heating the sole plate 13 comprises two or more halogen lamps, the regulator 21 or a discrete regulator can include means for selectively connecting one, two or more lamps in circuit with the source of electrical energy. The quantity of heat which is transmitted to and stored in the sole plate 13 is proportional to the number of active halogen lamps.

An advantage of halogen lamps is that they can begin to emit heat at a maximum rate practically without any delay in response to completion of the electric circuit as well as that the emission of heat is terminated in immediate response to opening of the circuit. As mentioned above, the lamps which are used in the improved iron are preferably designed to emit a large percentage of radiation in the infrared range of the spectrum. This renders it possible to use the lamp or lamps as an infrared dryer, i.e., as a device which transmits energy (in the form of infrared radiation) that is necessary to evaporate liquids from articles to be ironed. Infrared radiation is readily absorbed by liquids so that the lamp or lamps of the improved iron can be used as a means for ensuring predictable and efficient evaporation of liquids or the like from the articles to be ironed. The evaporation of liquids is even more satisfactory due to the fact that textile materials and like substances absorb relatively small quantities of infrared radiation.

The number of halogen lamps and/or the dimensions of such lamps will be selected with a view to ensure that the iron can maintain the sole plate 13 at a temperature within the desired range as well as that the articles on the ironing board can be reached by requisite quantities of infrared radiation. A single commercially available halogen lamp is sufficient for many applications. An advantage of several lamps is that the heating action can be altered within a desired range by the simple expedient of connecting different numbers of lamps in circuit with the source of electrical energy.

Another advantage of the improved iron is that its sole plate 13 need not be made of several materials, i.e., a one-piece sole plate of Ceran or an analogous material is ideally suited for accumulation and retention of requisite quantities of heat as well as for transmission of a high percentage of infrared radiation. Experiments indicate that sole plates made of vitreous enamel or the like are quite satisfactory. Moreover, such materials can exhibit a high degree of smoothness and a pronounced resistance to scoring, bulging and other forms of deformation and distortion. A sole plate of vitreous enamel or another ceramic material which exhibits the properties of Ceran offers practically no resistance to penetration by infrared radiation so that the rate of evaporation of liquids from the articles which are being ironed is very satisfactory. The coefficient of friction of such material is low which is another highly desirable characteristic of the improved sole plate. Smoothness is another of these desirable characteristics because it renders it possible to iron with a minimum of effort. Still further, the mechanical stability of a sole plate which is made of Ceran or the like is very satisfactory so that the underside of the sole plate remains smooth and flat in contrast to the aforediscussed sole plates which employ aluminum cores and base plates of steel. The manner of preferably separably connecting the sole plate to the housing 12 or an analogous housing is or can be the same as in conventional electric irons. Separable connection is desirable and advantageous because this enables a qualified person to inspect the interior of the iron, to clean the parts in the housing and/or to replace or repair damaged parts.

A single socket 23 will suffice if the improved iron employs a U-shaped halogen lamp having two free ends provided with terminals for installation in the single socket. However, and as explained in connection with FIG. 1, it is equally possible to employ one or more straight elongated halogen lamps and to provide a discrete socket for each end for each lamp or a first socket for the rear ends of all lamps and a second socket for the front ends of all lamps. The exact design of the parts (such as terminals and conductors) in the socket or sockets forms no part of the invention; such sockets are or can be furnished by the makers or distributors of halogen lamps.

The utilization of a reflector having a portion with a concave side whose center of curvature is in or on the sole plate is desirable and advantageous because such configuration and mounting of the reflector ensure that infrared radiation which is reflected by the reflector impinges upon the sole plate substantially at right angles to its plane. If a single lamp is used, such single lamp is or can be located at the focal point of the reflector, and more particularly at the focal point of the reflector portion which surrounds the lamp. It has been found that the reflector can effectively shield the housing 12 and its handle 11 from overheating.

An additional important advantage of the improved iron is its relatively low weight which is desirable in connection with practically all portable electric irons. The absence of any need for heat insulation or for extensive heat insulation of the housing 12 and handle 11 (e.g., by the provision of one or more insulating jackets between the outer side of the reflector and the housing) also contributes to a reduction of overall weight and to lower cost of the improved iron.

It is further within the purivew of the invention to provide the sole plate 13 with openings 14 of different sizes and/or shapes and to use two or more different types of steam discharging nozzles. The utilization of a single type and size of nozzles and of a sole plate having a number of uniformly distributed identical openings 14 is preferred at this time because it contributes to simplicity and lower cost of the iron. Moreover, such uniform distribution ensures a desirable distribution of steam in the articles which is being ironed.

Halogen lamps which can be used in the electric iron of the present invention are manufactured and distributed by Radium Lampenwerke Wipperfürth, German Federal Republic, under Catalog No. 12 1223 oo317.

Without further analysis, the foregoing will so fully reveal the gist of the present invention that others can, by applying current knowledge, readily adapt it for various applications without omitting features that, from the standpoint of prior art, fairly coinstitute essential characteristics of the generic and specific aspects of my contribution to the art and, therefore, such adaptations should and are intended to be comprehended within the meaning and range of equivalence of the appended claims.

I claim:

1. An electric steam iron, comprising a hollow housing having an open bottom; handle means provided on said housing for manipulating the iron; a sole plate secured to and covering the open bottom of said housing and composed of a light transmitting ceramic material which absorbs part of the light passing through the sole plate; means for heating said sole plate including a halogen lamp in said housing and in spaced relation to said sole plate and reflector means provided in said housing to reflect upon said sole plate light which is emitted by said lamp, the amount of light which is absorbed by the sole plate being sufficient to heat the sole plate to an ironing temperature, said housing further having a steam chamber which is disposed between said reflector means and said sole plate and is heated by radiant energy radiated by said lamp and/or reflected by said reflector means; means for admitting water into said chamber; and means for conveying steam from said chamber to a point of use.

2. The iron of claim 1, wherein said reflector means includes a portion having a concave surface facing said lamp and said sole plate.

3. The iron of claim 2, wherein said portion of said reflector means has a center of curvature at least close to said sole plate.

4. The iron of claim 1, wherein said sole plate has at least one opening and said conveying means comprises a steam discharging nozzle in the region of said opening and means for connecting said chamber with said nozzle.

5. The iron of claim 4, wherein said sole plate has a plurality of openings in a predetermined distribution and said conveying means comprises a nozzle in the region of each of said openings and means for connecting said chamber with said nozzles.

6. The iron of claim 1, further comprising at least one socket for said lamp in said housing.

7. The iron of claim 1, wherein said heating means comprises a plurality of halogen lamps.

8. An electric steam iron, comprising a hollow housing having an open bottom; handle means provided on said housing for manipulating the iron; a sole plate secured to and covering the open bottom of said housing and composed of a light transmitting ceramic material which absorbs part of the light passing through the sole plate; means for heating the sole plate including a halogen lamp in said housing in spaced relation to said plate and reflector means provided in said housing to reflect upon said sole plate light which is emitted by said lamp, the amount of light which is absorbed by the sole plate being sufficient to heat the sole plate, said housing further having a steam chamber which is heated by radiant energy radiated by said lamp and/or reflected by said reflector means and said reflector means surrounding at least a portion of said chamber; means for admitting water into said chamber; and means for conveying steam from said chamber to a point of use on the iron.

* * * * *